US006948192B2

(12) United States Patent
Hipponsteel

(10) Patent No.: US 6,948,192 B2
(45) Date of Patent: Sep. 27, 2005

(54) APPARATUSES FOR VENTILATING AND DEODORIZING AIR

(75) Inventor: Joseph B. Hipponsteel, 1109 S. Plaza Way #314, Flagstaff, AZ (US) 86001

(73) Assignee: Joseph B. Hipponsteel, Flagstaff, AZ (US)

( * ) Notice: Subject to any disclaimer, the term of this patent is extended or adjusted under 35 U.S.C. 154(b) by 0 days.

(21) Appl. No.: 10/112,428

(22) Filed: Mar. 29, 2002

(65) Prior Publication Data

US 2002/0189008 A1 Dec. 19, 2002

Related U.S. Application Data

(60) Provisional application No. 60/299,281, filed on Jun. 19, 2001.

(51) Int. Cl.[7] ..... E03D 9/04
(52) U.S. Cl. ..... 4/213
(58) Field of Search ..... 4/213

(56) References Cited

U.S. PATENT DOCUMENTS

| | | | | | |
|---|---|---|---|---|---|
| 3,069,696 | A | * | 12/1962 | Howell | 4/213 |
| 3,585,651 | A | * | 6/1971 | Cox | 4/348 |
| 3,939,506 | A | | 2/1976 | Pearson | |
| 4,174,545 | A | | 11/1979 | Smith, Jr. | |
| 4,273,032 | A | | 6/1981 | Spain | |
| 4,317,242 | A | | 3/1982 | Stamper | |
| 4,583,250 | A | | 4/1986 | Valarao | |
| 4,590,629 | A | | 5/1986 | Lusk | |
| 4,780,913 | A | | 11/1988 | Williams | |
| 4,876,748 | A | * | 10/1989 | Chun | 4/213 |
| 4,882,790 | A | | 11/1989 | Ricard | |
| 5,054,130 | A | | 10/1991 | Wilson | |
| 5,125,119 | A | | 6/1992 | Munoz | |
| 5,161,262 | A | | 11/1992 | Quaintance, Sr. | |
| 5,325,544 | A | | 7/1994 | Busch | |
| 5,403,548 | A | * | 4/1995 | Aibe et al. | 422/5 |
| 5,488,741 | A | | 2/1996 | Hunnicutt, Jr. | |
| 5,530,971 | A | | 7/1996 | Anderson | |
| 5,555,572 | A | | 9/1996 | Hunnicutt, Jr. | |
| 5,671,484 | A | | 9/1997 | Lee, III | |
| 5,718,005 | A | | 2/1998 | Ng | |
| 5,906,009 | A | | 5/1999 | Sakar | |
| 6,003,157 | A | | 12/1999 | Bruyere | |
| 6,018,824 | A | | 2/2000 | Pearson | |
| 6,041,449 | A | | 3/2000 | Brown et al. | |
| 6,052,837 | A | | 4/2000 | Norton et al. | |
| D424,185 | S | | 5/2000 | Brown et al. | |
| 6,088,845 | A | | 7/2000 | Estrada | |
| 6,158,058 | A | | 12/2000 | Martens | |
| 6,173,453 | B1 | | 1/2001 | Shahar | |
| 6,209,146 | B1 | | 4/2001 | Gonzalez | |
| 6,233,750 | B1 | * | 5/2001 | Donald et al. | 4/213 |
| 6,247,189 | B1 | | 6/2001 | Dean et al. | |
| 6,249,919 | B1 | | 6/2001 | Bryson, Jr. et al. | |
| 6,260,214 | B1 | | 7/2001 | Smith | |
| 6,282,732 | B1 | | 8/2001 | Krvavica et al. | |
| 6,287,191 | B1 | | 9/2001 | Barker, II | |

* cited by examiner

*Primary Examiner*—Charles E. Phillips
(74) *Attorney, Agent, or Firm*—Alston & Bird LLP

(57) ABSTRACT

To accomplish the task of removing foul air, the malodor ventilation apparatus has attachment members such as suction cups or a hook for easy installation in different locations. The apparatus has an inlet port for the intake of objectionable air and an outlet port to expel scented refreshed air. Air is drawn into the inlet port by a motorized fan that creates a pressure differential. The objectionable air is drawn through a porous filter. The porous filter is scented by several drops of a liquid scent. This scent is volatized into the malodorous air, changing the air into a pleasing aroma. The scented air is expelled and dissipated through an outlet port of the apparatus. Alternately, the apparatus can comprise a vent duct coupled to exhaust air from the outlet port.

12 Claims, 16 Drawing Sheets

FIG. 3B BOTTOM VIEW

FRONT VIEW

LEFT VIEW

RIGHT VIEW

PLAIN VIEW

REAR VIEW

ISOMETRIC VIEW

FILTER TOP VIEW

TOP VIEW

APPARATUSES FOR VENTILATING AND DEODORIZING AIR

CROSS REFERENCE TO RELATED APPLICATIONS

This patent application claims priority under Title 35, United States Code Section 119(e) to U.S. Provisional Patent Application No. 60/299,281 entitled "Bathroom Toilet Air Vacuum Filtering Deodorizing Venting Apparatus" filed on Jun. 19, 2001, which is incorporated in its entirety by reference and made a part hereof.

BACKGROUND OF THE INVENTION

1. Technical Field

The invention relates generally to the field of odor ventilation and, more particularly, to venting and scenting malodorous air to render it inoffensive to the human sense of smell.

2. Background Art

The need for removal of offensive odors has long been recognized. Consequently, many forced air ventilation devices that filter noxious odors have been developed. However, these devices have been subject to various disadvantages. Such devices are typically inefficient in operation, unsightly in appearance, and/or costly to manufacture. In addition, such devices require expensive installation and/or cannot be placed at the source of the odor generation. Further, such devices have generally not been effective in treatment of malodorous air from the area in which the device is operated. As a result, many of these devices have not achieved as widespread commercial success as could be possible.

Attempted elimination of noxious odors has been addressed in many ways including room exhaust fans, aerosol dispensed freshening deodorants, and forced air charcoal filtering. Many of these devices are intended for use in positions relatively far from the source of malodorous air and are thus rendered less effective for this reason. A further disadvantage of many such prior art devices is the large number of working parts that makes the device relatively complex to assemble and expensive to manufacture. A related problem is that such complex devices wear out or break relatively soon due to their numerous parts and part couplings that are critical to the device's operation. In general, the larger the number of parts and part couplings a device has, the sooner the device will wear out or break due to damage, wear, or displacement of one or more parts. Another problem is that many of the compact filtering units cannot eliminate or neutralize malodorous air. Other ventilation devices cannot be hidden or made less noticeable when attached to an object. The overall appearance of the device and object thus suffer. Moreover, many previous devices are unsightly and too large to be hidden from view. Furthermore, previous devices are not generally adaptable to be attached to different objects. Moreover, many previous devices have failed to provide an effective mechanism to control the fan. Additionally, other systems are not adaptable to remove or treat malodorous air from a multitude of locations. In many instances, malodorous source generation is in an inconvenient location in which a known filtering unit would be inadequate due to the lack of any mechanism to reach to an area near the source. In addition, some areas in which it may be desired to operate such devices are not proximate to a wall power outlet or other source of electric power. Another problem with previous devices is that many use activated charcoal as a filter media. It would be desirable to provide a filter that is more effective than charcoal in the elimination of odors from air. In addition, some previous devices are ineffective in obtaining their intended purpose, eliminating or treating malodorous air. It would be desirable if these disadvantages of previous devices could be overcome.

Although a multitude of devices have been proposed for removing foul air, problems have arisen for the removal of the malodor from an interior portion of an object while circulating refreshed air. Consequently, there exists a continued need for an improved ventilating apparatus that can efficiently remove malodor from the air with an inexpensive apparatus capable of deployment with a multitude of different objects.

SUMMARY OF THE INVENTION

The present invention, in its various embodiments and features, satisfies the aforementioned needs and overcomes the above-noted shortcomings of previous devices.

An apparatus according to a first aspect of the invention functions to dissipate malodorous air. The apparatus comprises a casing, an element for removably attaching the casing to an object, a motorized fan, a conduit, an intake member, and an element for removably attaching the intake member to the object. The casing defines an inlet port and an outlet port. The motorized fan creates a partial vacuum or pressure differential that draws the air into the inlet port and exhausts the air from the outlet port. The conduit has a first end coupled to the casing's inlet port, and the intake member coupled to a second end of the conduit. The apparatus can further comprise an energy source coupled to the motorized fan. The energy source can be a battery and/or a transformer and electrical extension cord coupled to a wall outlet, for example. The motorized fan can be adaptable to selectively receive power from a battery housed within the casing or a wall outlet. In addition, the apparatus can comprise a timed duration control unit coupled to the motorized fan, that is controllable to activate the motorized fan for a period of time. The apparatus can comprise a switch coupled to the timed duration control unit, for activating the timed duration control unit to operate the motorized fan. The switch can comprise a motion or heat sensor that activates the timed duration control unit to operate the motorized fan, based on movement or heat of a person's body in proximity to the object. Alternatively, the switch can comprise a sensor for detecting pressure for activation of the timed duration control unit to operate the motorized fan, based on force applied by a person. Force can be applied by either the weight of the person's body or pressing the switch with a finger, for example. Alternatively, or in addition to the above-described features, the switch can be manipulated by a person to activate the timed duration control unit to operate the motorized fan. The apparatus can further comprise an element coupled to the switch, for removably attaching the switch to the object. The timed duration control unit can be functional to provide the energy source from an internal or external energy source. The object can be a toilet stand, cat litter box, or a waste disposal container, for example. Moreover, the apparatus can comprise a porous filter situated with respect to the casing so as to receive air from the inlet port, and a liquid or oil fragrance for application to the porous filter, for treating the air from the inlet port so as to be fragrant upon passing through the filter. The porous filter can comprise a paper, natural or synthetic fiber material, or charcoal, for example, and is absorbent to allow the liquid or oil fragrance to permeate it. The apparatus can further comprise an inlet nozzle member coupled to the casing and the conduit to duct air from the conduit to the inlet port of the casing. The inlet nozzle member can define a relatively wide opening where it meets with the casing and a relatively narrow opening where is meets with the conduit. The inlet nozzle member defines a passage between its two openings to channel air through such member. The elements used to removably attach the casing, intake member and/or switch to the object can be one or more suctions cups or hooked members, for example. The elements used to removably attached the casing, intake member and/or switch to the object can comprise one or more suction cups or hooked members, for example. The conduit can comprise a flexible hose for ducting the air from the intake member to the casing's inlet port. The apparatus can comprise a vent duct coupled to the casing to vent air from the outlet port.

An apparatus according to a second aspect of the invention comprises a casing, attachment member, motorized fan, and inlet nozzle member. The casing defines an inlet port and an outlet port. The attachment member is coupled to the casing, and is used to removably attach the casing to an object. The motorized fan creates a partial vacuum that draws the air into the inlet port and exhausts the air from the outlet port. The inlet nozzle member is coupled to the casing and defines a passage with a relatively wide opening meeting with the inlet port of the casing and a relatively narrow opening opposite the relatively wide opening. The apparatus can comprise an energy source coupled to the motorized fan. The energy source can comprise a battery and/or a transformer coupled to receive power from a wall outlet. The motorized fan is adaptable to selectively receive power from a battery housed within the casing or a wall outlet. The timed duration control unit coupled to the motorized fan, and controllable to activate the motorized fan for a period of time. The apparatus can comprise a switch coupled to the timed duration control unit, for activating the timed duration control unit to operate the motorized fan. The switch can comprise a motion or heat sensor that activates the timed duration control unit to operate the motorized fan, based on movement or heat of a person's body in proximity to the object. Alternatively, the switch can comprise a pressure sensor for activation of the timed duration control unit to operate the motorized fan, based on finger force or weight of a person's body. The switch can be manipulated by a person to activate the timed duration control unit to operate the motorized fan. The apparatus can further comprise an element coupled to the switch, for removably attaching the switch to the object. The timed duration control unit can be functional to provide the energy source from an internal or external energy source. The object to which the apparatus is attached can be a toilet stand, waste disposal container, or cat litter box, for example. The apparatus can further comprise a porous filter situated with respect to the casing so as to receive air from the inlet port, and a liquid or oil fragrance applied to the porous filter, for treating the air from the inlet port so as to be fragrant upon passing through the filter. The apparatus can further comprise a conduit having a first end coupled to the inlet nozzle member at its relatively narrow opening, an intake member coupled to a second end of the conduit, and at least one element coupled to the intake member, for removably attaching the intake member to the object. The conduit can comprise a flexible hose. The inlet nozzle member can be removably attached to the casing. The apparatus can comprise a vent duct coupled to the casing to vent air from the outlet port.

In the above-described aspects of the invention, the casing, intake member, and inlet nozzle member can be made of rigid materials such as hard plastic or metal, for example. The conduit can be a hose made of flexible rubber material or plastic material. The plastic material is optionally transparent. The attachment members, if implemented as suctions cups, can be composed of resilient, high-friction plastic material to grip the object to which they are attached. If implemented as hooked members, such elements can be composed of hard plastic or metal.

BRIEF DESCRIPTION OF THE DRAWINGS

Benefits and further features of the present invention will be apparent from a detailed description of embodiments thereof taken in conjunction with the following drawings, wherein like elements are referenced with like numbers, and wherein:

FIGS. 3A, 3B, 3C, 3D are bottom, front, left, and right views of an embodiment of a malodor ventilation apparatus.

DETAILED DESCRIPTION OF THE INVENTION

The described embodiment discloses an apparatus that provides an efficient, compact, and reliable method of ventilating malodorous air from an area. An embodiment of the new and improved ventilating apparatus embodying the principle and concepts of the present invention and generally designated by the numeral 100 will be described.

Figure 1:
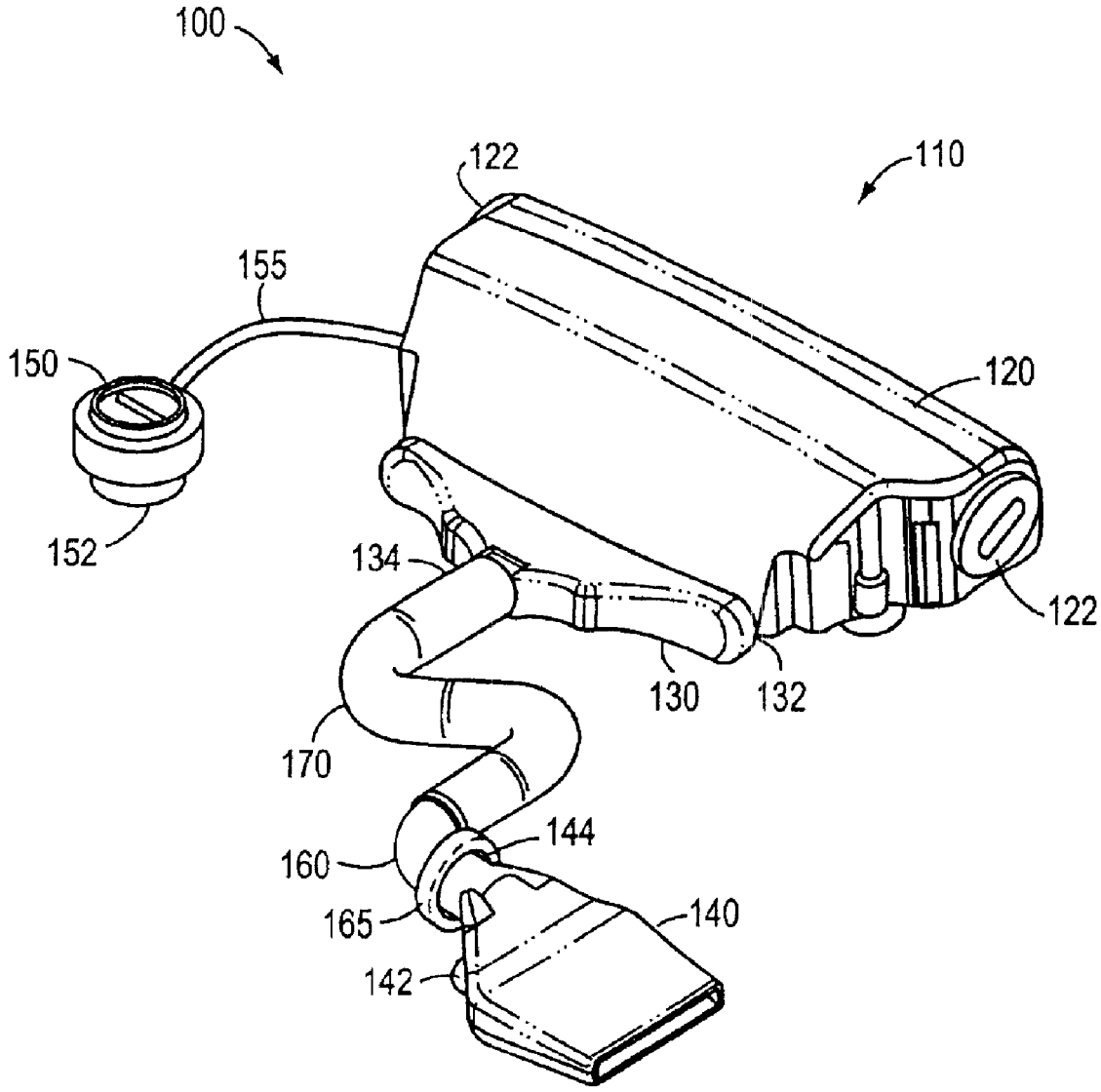
FIG. 1 is an isometric top view of an embodiment of a malodor ventilation apparatus with an intake member.

Referring to FIG. 1, an apparatus 100 of the invention generally comprises a casing 110, an inlet nozzle member 130, an intake member 140, a switch 150, and a conduit 170. The apparatus 100 also comprises internal ventilating elements 600 that are not shown in FIGS. 1 and 2, but are shown in FIG. 6.

Figure 2:
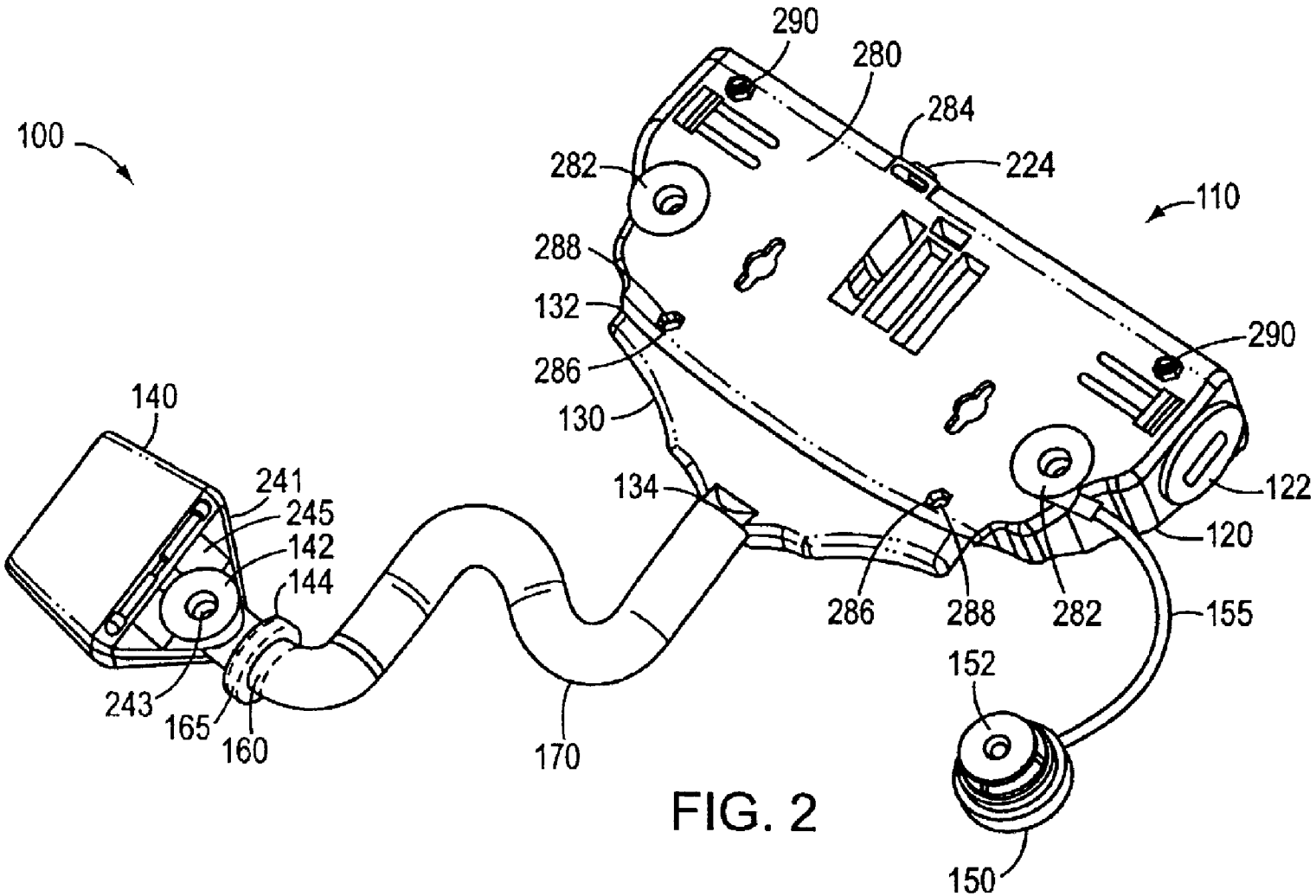
FIG. 2 is an isometric bottom view of an embodiment of a malodor ventilation apparatus with an inlet extension defined by a conduit and intake member.

The casing 110 comprises a top casing part 120 and a bottom casing part 280 that define an enclosure to house and protect the internal ventilating elements 600. The top casing part 120 comprises a latching mechanism 224 to snap the top casing part firmly in place with the bottom casing part 280. An embodiment of the top latching mechanism 224 includes a plastic protrusion designed to snap into the latching receptacle 284. Although only one latching mechanism 224 and corresponding receptacle 284 are shown in FIG. 2, latching of the top casing part 120 to the bottom casing part 280 can be accomplished by a series of protrusions 224 that snap into corresponding latching receptacles 284 to hold the top and bottom parts 120, 280 together. Screws 286 can further secure the top casing part 120 and the bottom casing part 280. The screws 286 are threaded through screw holes 288 defined in the bottom casing part 280, and screwed into the top casing part 120 to hold together the top and bottom casing parts. The internal ventilating elements 600 (see FIG. 6) and associated batteries for powering such elements can thus be contained and secured within the casing 110 for their protection. In addition, the casing 110 provides for a compact arrangement and attractive appearance for the apparatus 100.

The bottom casing part 280 includes two attachment members 282. The attachment members 282 can comprise suction cups that enable the apparatus 100 to be easily and securely placed where desired. However, the attachment members 282 can be removable from an object to which the apparatus 100 is attached so that the apparatus can be moved to another location at a later time if desired.

The bottom casing part 280 can comprise stabilization feet 290. The stabilization feet 290 protrude from the bottom casing part 280 at spaced positions on such part to prevent wobbling and to enable the apparatus 100 to rest stably on an object. The malodor ventilation apparatus 100 can be placed inside trash receptacles, on a toilet stand, a cat litter box or wherever objectionable odors originate.

As previously mentioned, the ventilation apparatus 100 comprises the switch 150. The switch 150 is electrically coupled to the internal ventilating elements 600 of the apparatus 100 by electrically conductive switch wires 155. Upon activation of the switch 150, the internal ventilating elements 600 of the apparatus 100 optionally can run for a predetermined time period from a fraction of a second to several hours or more, several minutes being sufficient for many applications. A switch suction cup 152 attached to the switch 150 allows for easy, secure, and movable placement on an object. The switch 150 can thus be conveniently located for easy activation of the unit 100. Optionally, the switch 150 may also be a motion or heat sensor for activation of the unit 100. Hence, the malodor ventilation apparatus 100 can be configured for multiple activation methods.

The top casing part 120 contains battery access ports 122 for easy access to insert and replace batteries as needed. The device 100 can also have an external power input plug 324 shown in FIG. 3A for operation with an external power source (not shown). Hence, the ventilation apparatus 100 can be operated to power internal ventilating parts 600 using batteries 620 and/or external power provided from a wall outlet, for example. An embodiment of the apparatus 100 comprises an intake member 140 as depicted with reference to FIGS. 1 and 2. The intake member 140 can be used to extend the suction inlet of the apparatus 100 into an area in which the casing 110 cannot fit or in which it may not be desirable to locate the device for reasons of appearance or interference with operation of the object to which the apparatus is attached, for example. An attachment member 142 is mounted to the intake member 140 to removably attach such part to an object. The attachment member 142 can be a suction cup, for example. The extended inlet part 140 can be coupled to an inlet nozzle member 130 that communicates with the inlet port of the casing 120. The inlet nozzle member 130 defines a sleeve 132 configured to mount tightly over the apparatus inlet lips 323 of the inlet port defined in the casing 110 shown in reference to FIG. 3A. The inlet nozzle member 130 also has a connection nose 134 designed to form fit within the conduit 170. The conduit 170 can be a flexible tube or hose, for example. Preferably, the conduit 170 has sufficient resilience that its internal passage is not blocked if the conduit is bent. The flexible connection hose 170 connects with the nozzle connector 160 such that it fits securely within the inside of the flexible hose 170 in airtight engagement therewith. The nozzle connector 160 also has an extended neck section 165 that fits loosely inside an outer neck ring 144 of the extended inlet part 140. The outer neck ring 144 enables the extended inlet part 140 to rotate three-hundred-sixty degrees while maintaining airtight coupling to the nozzle connector 160 that is sufficient to ventilate malodorous air. The attachment member 142 is attached by a screw 243 to the inlet attachment member rotatable flap 245. The inlet attachment member rotatable flap 245 is attached to the intake member 140 by a hinge 241. The hinge 241 enables the attachment member 142 to rotate from zero to approximately one-hundred-eighty degrees about the bottom plane of the intake member 140.

The ability of the intake member 140 to rotate around the nozzle connector 160 and the ability of the attachment member 142 to rotate relative to the part 140 provide enhanced flexibility to position the intake member 140 at a desired location to maximize the ability to draw malodorous air in proximity to its source. As shown, the extended inlet 140 provides the apparatus 100 with flexibility to acquire objectionable air from remote structures.

Figure 3A:
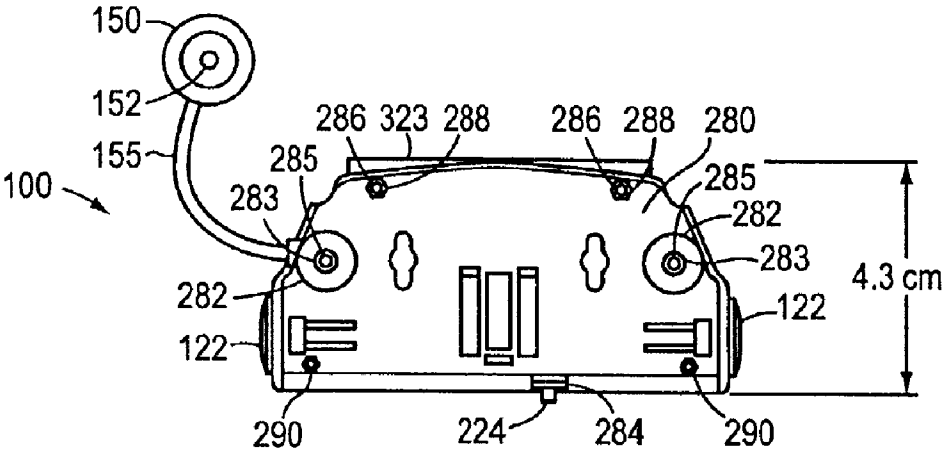
Figure 3A:
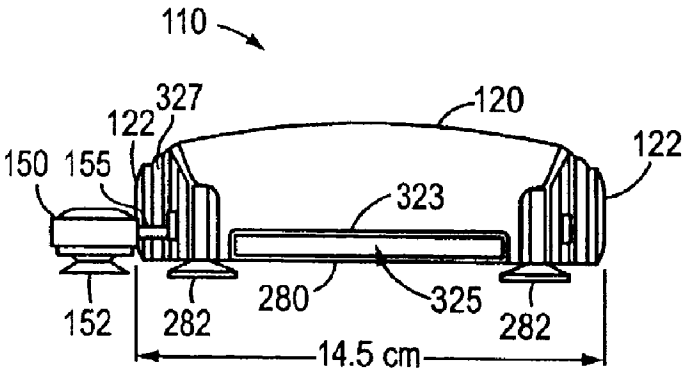
Figure 3D:
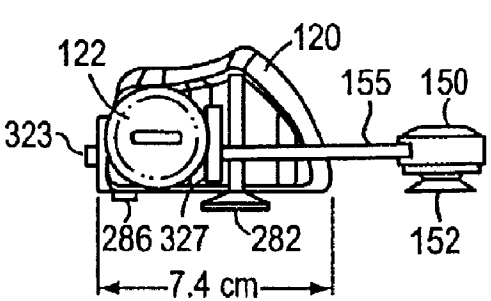
Figure 3C:
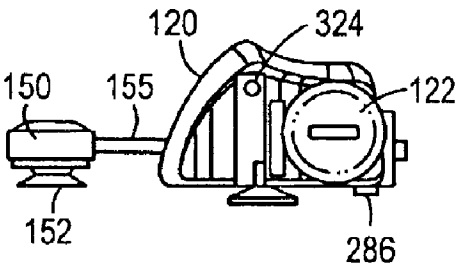

FIGS. 3A–3D are various views of elements of the apparatus 100 that have been previously described for the most part. Referring to FIG. 3A, the casing 110 comprises top and bottom casing parts 120, 280 that when joined together define inlet lips 323 that engage with inlet nozzle member 130. The inlet lips 323 surround and define the casing's inlet port 325. Also visible in FIG. 3A are attachment members 282 mounted to bottom casing part 280 for removably attaching the apparatus 100 to an object. Further visible in FIG. 3A are battery access ports 122 that can be used to insert or extract batteries in the apparatus 100 to power the internal ventilating elements 600. FIG. 3A also shows the switch 150 and its attachment member 152 to attach such switch to an object. Conductive wires 155 are coupled to the switch 150 and the internal ventilating elements 600, and extend through slit 327 defined for this purpose in the top casing part 120. FIG. 3B is a view of the bottom casing part 280 and associated elements. The bottom casing part 280 has attachment members 282 mounted thereto by screws 283 inserted in respective holes 285 defined in the bottom casing part 280 to secure the attachment members to the casing 110. In FIG. 3C plug 324 is clearly shown in the side of the apparatus 100. Such plug 324 can be coupled to an eight Volt power transformer, for example, to power the apparatus 100 in lieu of or in addition to battery power. In FIG. 3D the top casing part 120 defines a slit 327 through which can be passed the conductive wires 155 coupling the switch 150 to the internal ventilating elements 600 of the apparatus 100.

Figure 4B:
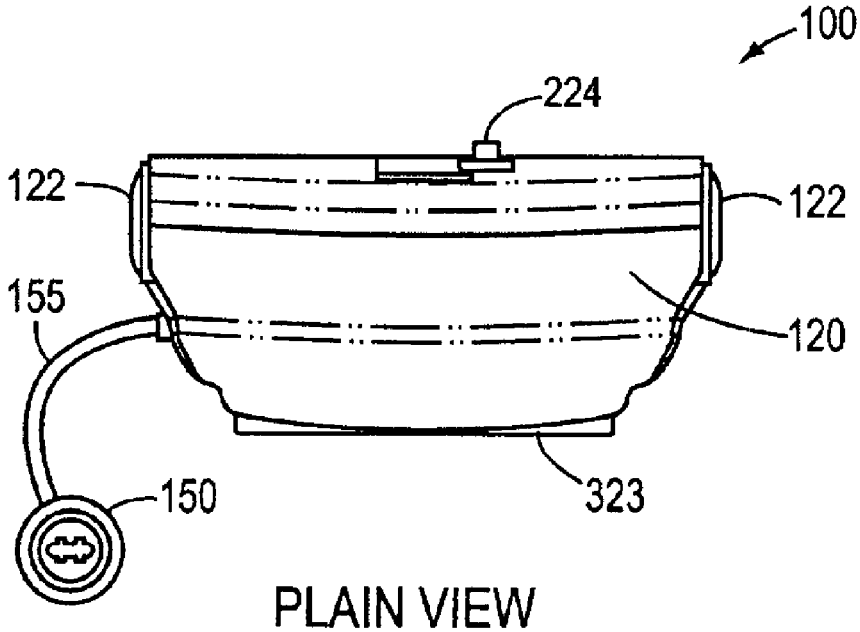
FIGS. 4A and 4B are plan and rear views of an embodiment of a malodor ventilation apparatus.
Figure 4A:
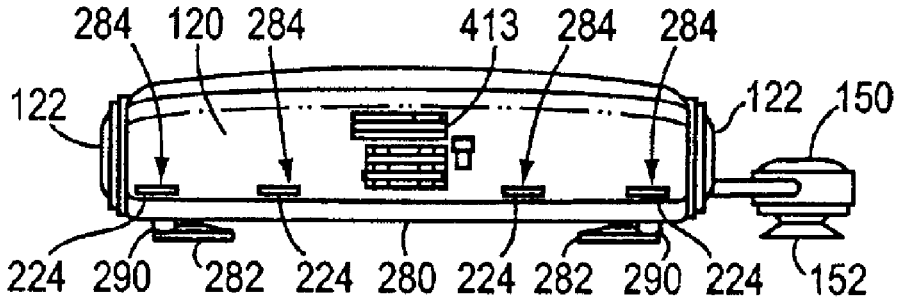

In FIGS. 4A and 4B the apparatus 100 comprises a plurality of latching mechanisms 224 formed in bottom casing part 280 that engage with respective receptacles 284 defined in the top casing part 120 to hold together the top and bottom casing parts. Outlet port 413 is shown defined in the top casing part 120. The outlet port 413 exhausts air drawn from the inlet port through the apparatus 100 by the internal ventilating elements 600. Switch 150 with attachment member 152 and battery access ports 122 are also shown in FIGS. 4A and 4B.

Figure 5B:
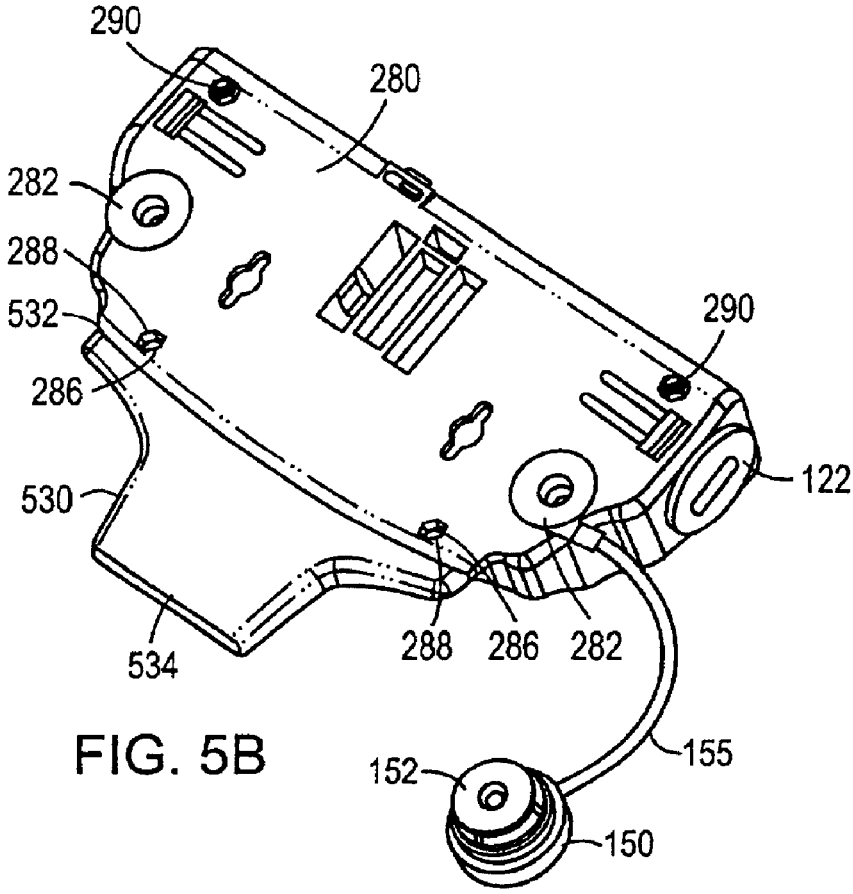
FIGS. 5A and 5B are isometric views of an embodiment of a malodor ventilation apparatus with a fixed inlet nozzle.
Figure 5A:
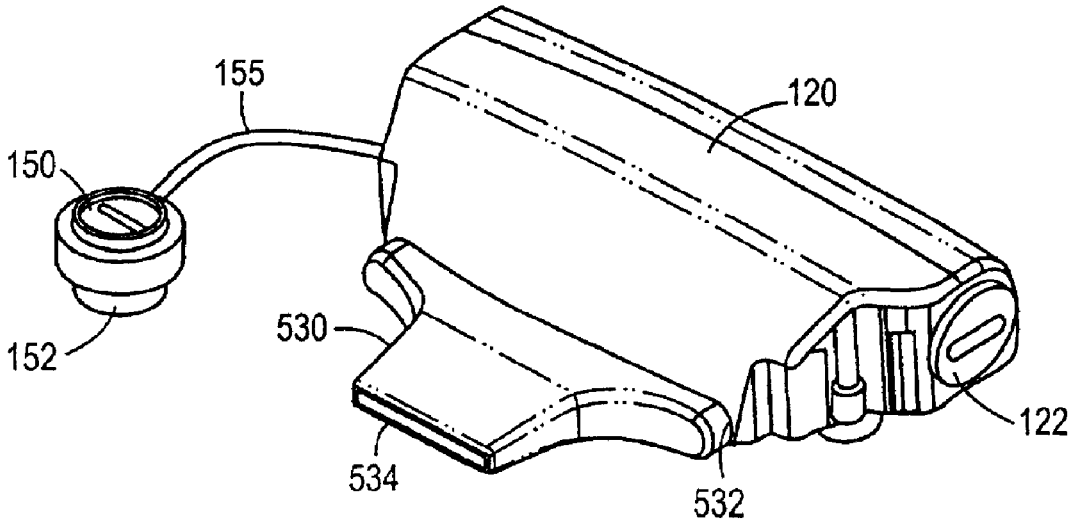

In FIGS. 5A and 5B the apparatus 100 comprises an inlet nozzle member 530 that replaces the inlet nozzle member 130, conduit 170, and intake member 140. The fixed inlet nozzle member 530 functions to focus the area in which the objectionable air is drawn. Additionally, the inlet nozzle member 530 protects the internal components of the malodor ventilation apparatus 100 from splash and other debris. The fixed inlet nozzle member 530 defines an internal passage extending from end 132 defining a relatively wide opening to end 534 defining a relatively narrow opening 534. The opening of the wide end 532 can be designed to press fit onto the inlet lips 323 of casing 110. Consequently, the fixed inlet nozzle member 530 can be easily removed for cleaning and reattached to the casing 110.

Figure 6A:
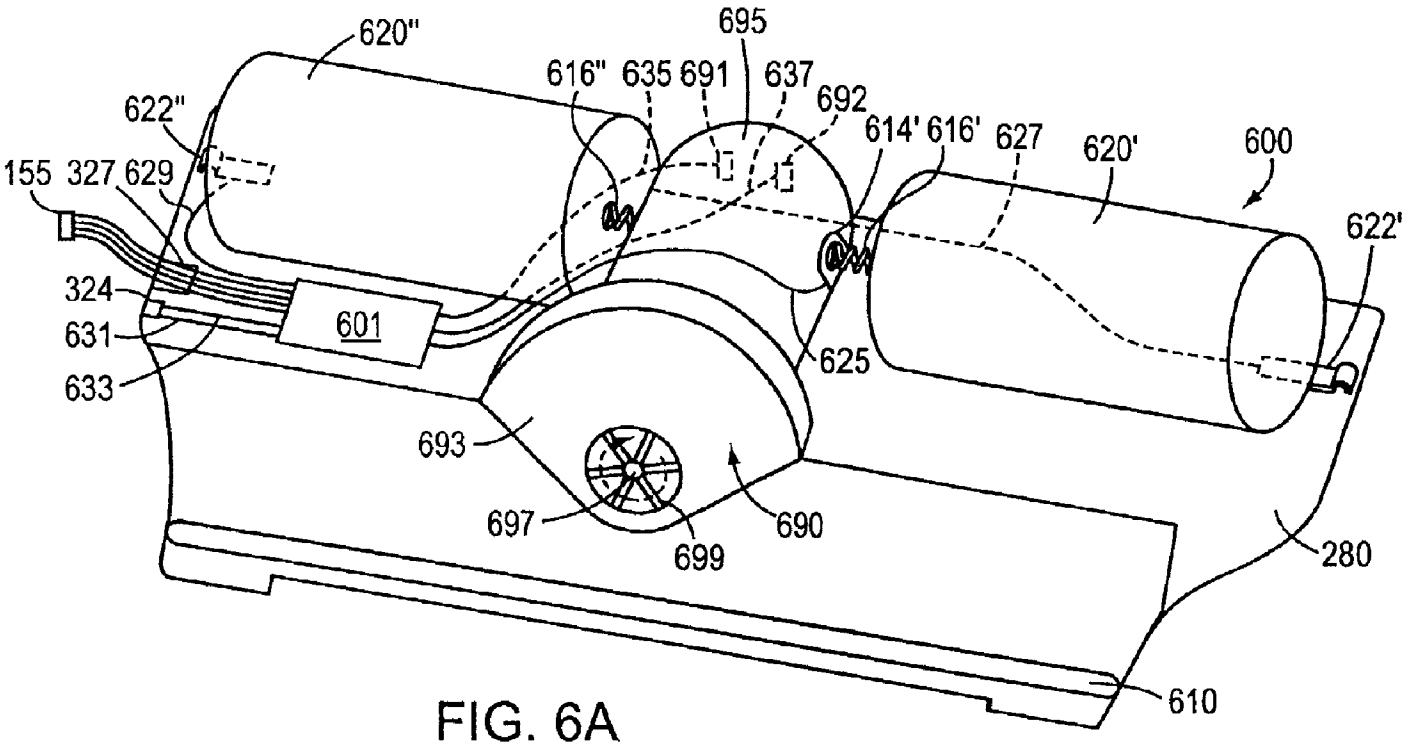
FIGS. 6A, 6B and 6C are views of an embodiment of internal ventilating elements and related parts of malodor ventilation apparatus in accordance with the invention.
Figure 6C:
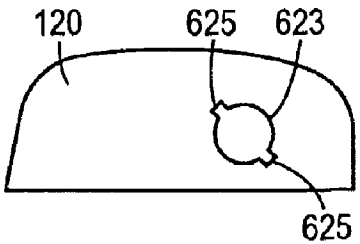
Figure 6B:
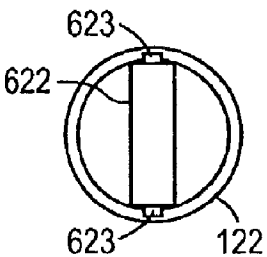

FIG. 6 illustrates an embodiment of the internal ventilating elements 600 of the malodor ventilation apparatus 100. The switch 150 causes the activation of a motorized fan 690. The motorized fan 690 is powered by two "D-size" batteries 620 and/or via an external power source coupled to power the motorized fan 690 via the electric plug 324. Two batteries 620', 620" operate in series to power the motorized fan 690. More specifically, the anode of the first battery 620' physically contacts a first metal spring 616'. The first metal spring 616' is physically and electronically coupled to a first metal spring plate 614'. The spring plate 614' is coupled via line 625 to a control unit 601 of the apparatus 100. As shown in FIG. 6B the cathodes of the batteries 620', 620" have associated therewith respective battery access ports 122. These have keys 623 on opposite sides of the ports 122. The port 122 is positioned over the aperture 623 so that its keys 623 are inserted in respective notches 623 defined adjacent the aperture 625 in the top casing part 120. By placing the keys 623 in the notches 625 and by rotating the ports 122 to a degree so that the keys 623 move past the notches, the keys 623 engage with the top casing part 110 and hold the ports 122 to the top casing part 120. The ports 122 are each provided with a metal battery cover plate 622. If the port 122 is secured to the top casing part 120 with the battery 620' inside of the casing 110, the cover plate 622 engages with the protruding cathode of the battery 620' to make electrical contact therewith. The cover plate 622 further extends to and makes electrical contact with a second metal battery base plate 622' when properly positioned. The second metal battery base plate 622' is mounted to the top casing part 120 and is coupled via insulated conductive line 627 to the second spring plate 614". The spring plate 614" is coupled to the spring 616" that makes physical and electrical contact with the anode of the battery 620". A similar port 122 to that previously described is fitted to the top casing part 120 so that it is base plate 622 makes electrical contact with the base plate 622". The base plate 622" is mounted to the bottom casing part 280 and is electrically coupled to insulated conductive wire 629. The wire 629 coupled the base plate 622" to the control unit 601. Thus, the control unit 601 receives electric power from batteries 620', 620".

The control unit 601 is coupled via conductive wires 631, 633 to plug 324. A three-volt AC-to-DC transformer or converter can be attached to a wall outlet and coupled to the plug 324 to provide electric power to the control unit 601. The control unit 601 is also coupled to conductive wires 155 from the switch 150. The control unit 601 can be in the form of a circuit board such as a model no. CBJFTO1 commercially available from Products of Tomorrow, Inc. of New Jersey and Hong Kong. The control unit receives an input signal from the external switch 150 via the switch wires 155 upon activation of the switch. The control unit 601 activates the fan upon receipt of an input signal from the switch 150. The control unit 601 can have a timer to deactivate the motorized fan 690 after a certain predetermined duration of time. Additionally, the control unit 601 can receive a signal indicating motion or heat from the switch 150 and activate the fan for a set period from which no significant motion or heat is detected. Control units 601 that are operable to control the function of a motorized fan 690 are well known in the art and can be purchased from numerous companies such as the afore-mentioned Products of Tomorrow, Inc. The control unit 601 can supply DC power to the motorized fan 690 via insulated conductive wires 635, 637. These wires 635, 637 can be coupled to respective positive voltage and ground terminals 691, 692 to supply power to the motorized fan 690. More specifically, the motorized fan 690 comprises a fan 693 and a DC motor 695. If the terminals 691, 692 of the DC motor 695 receive electric power from the control unit 601, the DC motor 695 generates magnetic fields based on the electric power to rotate its rotor 697 and thereby also the fan 693 attached to such rotor. Due to the configuration of its blades 699, the fan 693 creates a pressure differential that draws malodorous air into the casing 110 via its inlet port 325 and through the casing 110 to the outlet port 413 where it is exhausted and dissipated.

Figure 7A:
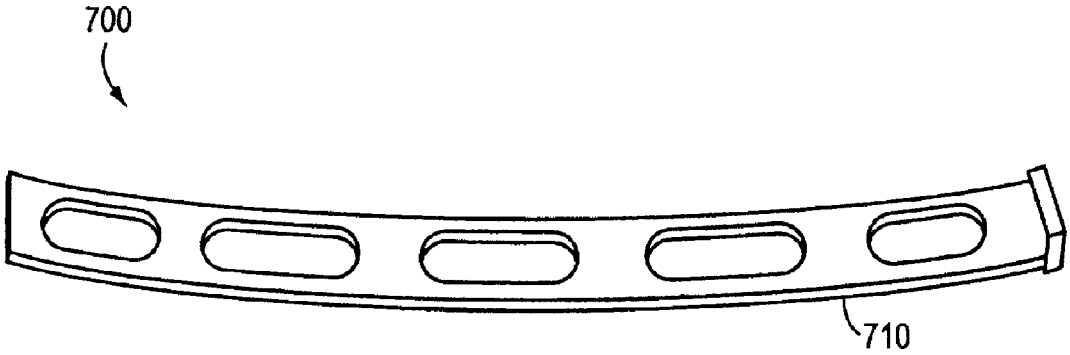
FIGS. 7A, 7B and 7C are views of an embodiment of a filter assembly of the ventilation apparatus of the invention.
Figure 7B:
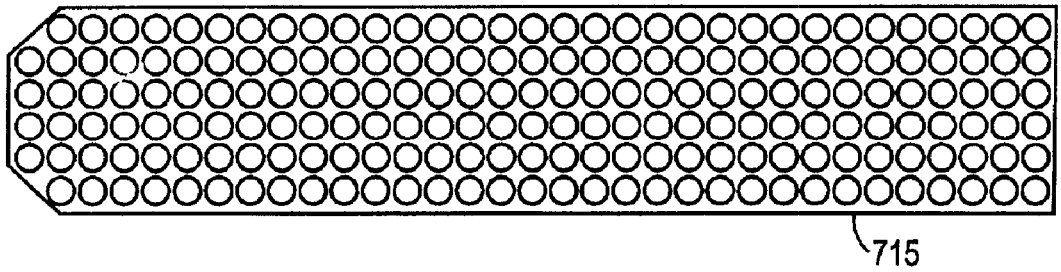
Figure 7C:
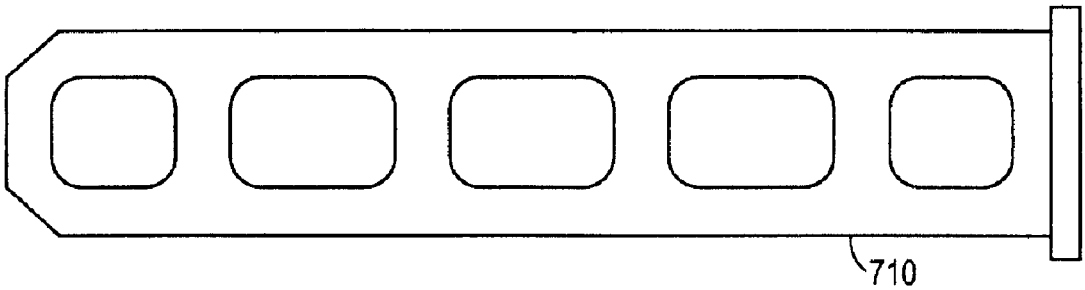

Referring now to FIGS. 7A–7C in addition to FIGS. 6A and 6B, a filter unit 700 is physically installed in the filter chassis grove 610 defined in bottom casing part 280. The filter unit 700 comprises a filter chassis 710 and a porous filter 715, as shown in FIGS. 7A and 7B, respectively. The filter chassis 710 can be constructed of hard plastic and has a series of holes through which air can freely pass. A porous filter 715 is physically coupled to the filter chassis 710, which can be accomplished by application of an adhesive, for example. The porous filter 715 is preferably a porous woven or compacted fiber fabric that can absorb liquid fragrances. The fibers composing the filter 715 can be wood pulp, cellulose, other plant, animal, and/or synthetic plastic fibers, for example. Liquid fragrances are well known in the art and can be commercially purchased at specialty shops or at large retailers such as the retailer operating under the trademark TARGET. As the air passes the porous filter 715, the malodorous air becomes aromatized, and the refreshed air is delivered out of the export port 413.

Figure 8:
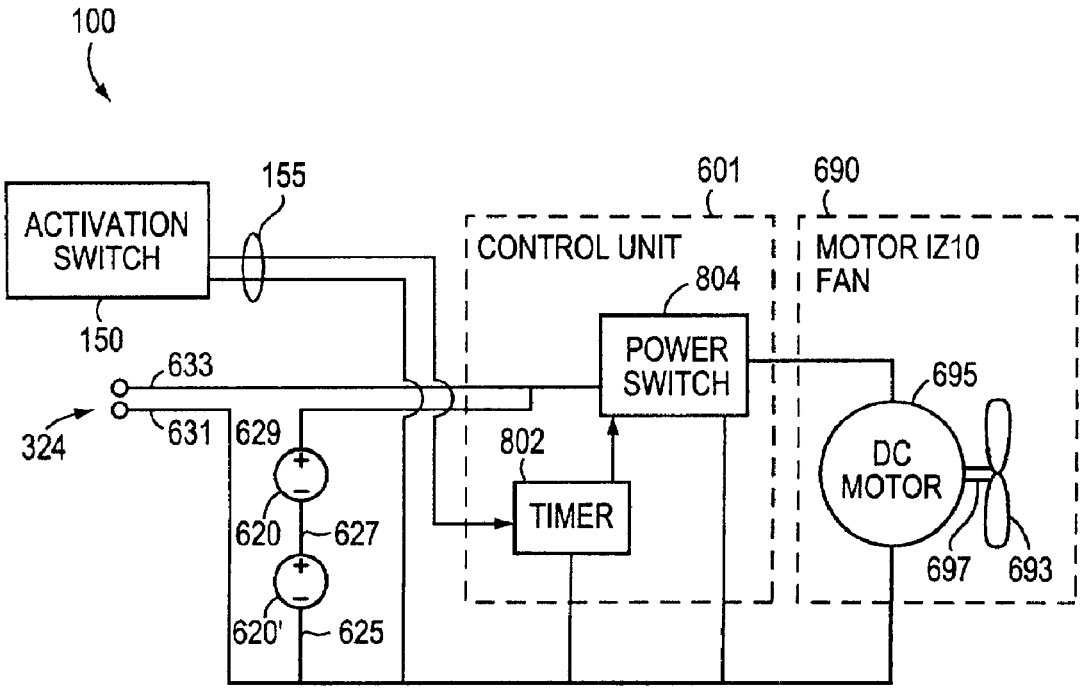
FIG. 8 is a circuit diagram of the apparatus in accordance with the invention.

Referring to FIG. 8, the control unit 601 comprises a timer 802 and a power switch 804. The timer 802 is coupled to the activation switch 150 via wires 155 to receive an input signal generated upon activation of the switch 150. The timer 802 is coupled to the power switch 804, and activates such power switch in response to activation the signal from the switch 150. Upon activation, the power switch 804 supplies DC power to the motorized fan unit 690. The power switch 804 can be coupled to batteries 620', 620" or an external DC power source via the plug 324, as previously described. Upon activation, the power switch 804 enters a conductive state and supplies DC power from the batteries 620', 620" or the external DC power source, or both. The power switch 804 supplies the DC power to the DC motor 695 that rotates the rotor 697 to turn the fan 693. The fan 693 draws air into the inlet port 325, through the fan and casing 110 to the outlet port 413 where it is expelled and dissipated.

The activation of the timer 802 by the switch 150 causes the timer to start measuring a predetermined amount of time starting from activation of the switch 150. An event triggering the activation of the switch 150 can be either the first or last application of pressure, heat and/or motion, depending upon the nature of the switch 150. Such time can be programmed or hardwired into the timer, and may be from one to thirty minutes, for example. The timer 802 maintains the activated state of the signal to the power switch 804 until the timer has counted out the predetermined time, at which time the timer 802 deactivates its signal to the power switch 804. This causes the power switch 804 to enter a non-conductive state to cut off electric power to the motorized fan 690, thereby stopping the fan 690. Hence, power and wear on the apparatus 100 can be reduced by automatically turning off the apparatus when it is not needed.

Figure 9A:
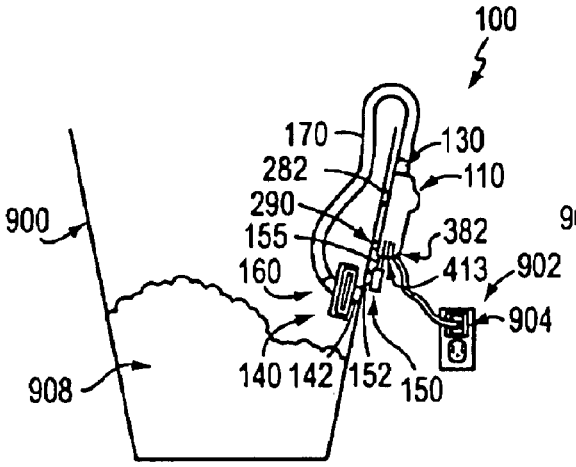
FIGS. 9A and 9B are two versions of the apparatus applied to use with a waste disposal container.
Figure 9B:
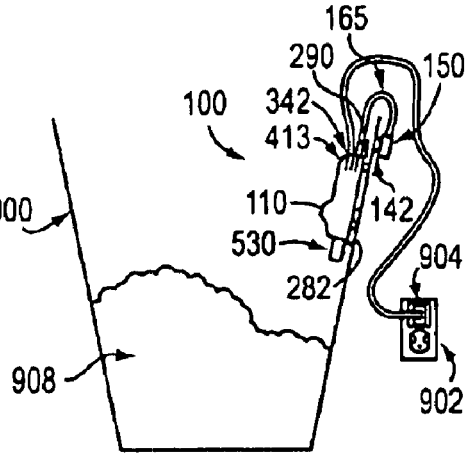

FIG. 9A shows the apparatus 100 used with a waste disposal container 900. The intake member 140 is attached inside container 900 with the attachment member 142. The conduit 170 is coupled to the intake member 140 and extends to the casing 110 attached to the outside of the container 900 with the attachment members 282 and supported by stabilization feet 290. The motorized fan 690 is coupled to receive electric power from batteries 620', 620" and/or via plug 342 coupled to external wall outlet 902 via a three-volt AC-to-DC converter 904. The motorized fan 690 draws malodorous air from waste 908 via intake member 140, conduit 170, and inlet nozzle member 130, and exhausts and dissipates such air via the casing's outlet port 413. Alternatively, the intake member 140, the conduit 170, and the inlet nozzle member 130 can be removed, and inlet nozzle member 530 can be attached to the casing 110, as shown in FIG. 9B. In this case, if desired, the apparatus 100 can be attached to the inside surface of the container 900 using the attachment members 282 so that the inlet nozzle member 530 is arranged to draw malodorous air from waste 908 and to exhaust and dissipate this air, optionally after deodorization via filter 715 and volatile liquid fragrance applied thereto, from the casing's outlet port 413.

Figure 10A:
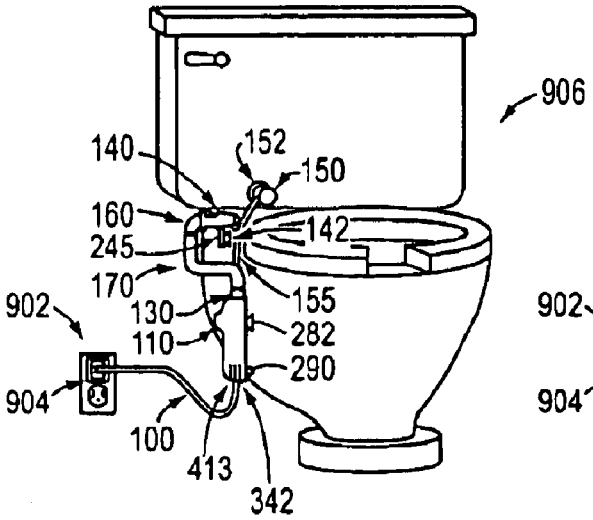
FIGS. 10A and 10B are two versions of the apparatus applied to use with a toilet stand.
Figure 10B:
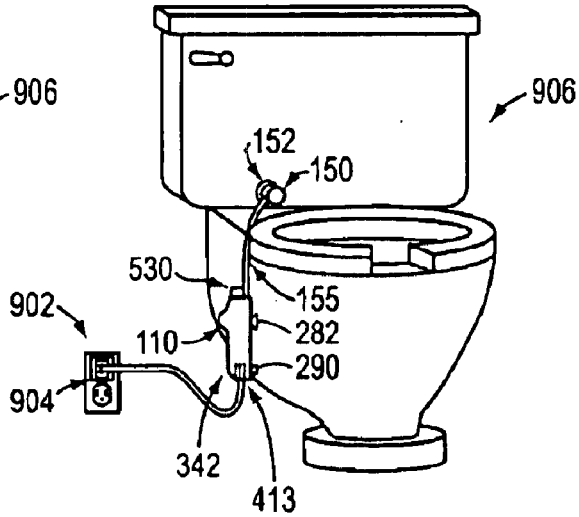

In FIG. 10A the apparatus 100 is applied to use with a toilet stand 906. The casing 110 of the apparatus 100 is attached to the toilet stand 906 via attachment members 282 and is stabilized by the feet 290. As previously described, the motorized fan 690 can be powered by the batteries 620', 620" and/or the wall outlet 902 via the converter 904. The casing's inlet 325 is coupled to conduit 170, connector 160, and intake member 140. The intake member 140 is attached to the toilet stand 906 via the attachment member 142 that is mounted to the rotatable flap 245 that is rotated downwardly from the bottom surface of the intake member 140. The rotatable flap 245 is thus seen to facilitate attachment of the intake member 140 to the toilet stand 906 in a location in which the casing 110 may not fit. The switch 150 is attached to the toilet stand 906 and is coupled to the internal ventilating elements 600 of the apparatus 100. The switch 150 can be pressure-, motion- and/or heat-activated. Upon activation via the switch 150, the apparatus 100 draws malodorous air via the intake member 140, conduit 170, and inlet nozzle member 130 using motorized fan 690 and dissipates same via outlet port 413, optionally with application of deodorizing fragrance via volatile liquid applied to the filter 170. FIG. 10B shows an alternative configuration of the apparatus 100 in which the inlet nozzle member 130, the conduit 170, and the intake member 140 are removed from the casing 110 of the apparatus 100, and the inlet nozzle member 530 is attached to the casing 110 of the apparatus 100. The apparatus 100 thus draws malodorous air via the inlet nozzle member 530 and dissipates it via the outlet port 413, optionally with deodorization applied via volatile fragrance from the filter 715 within such apparatus.

Figure 11A:
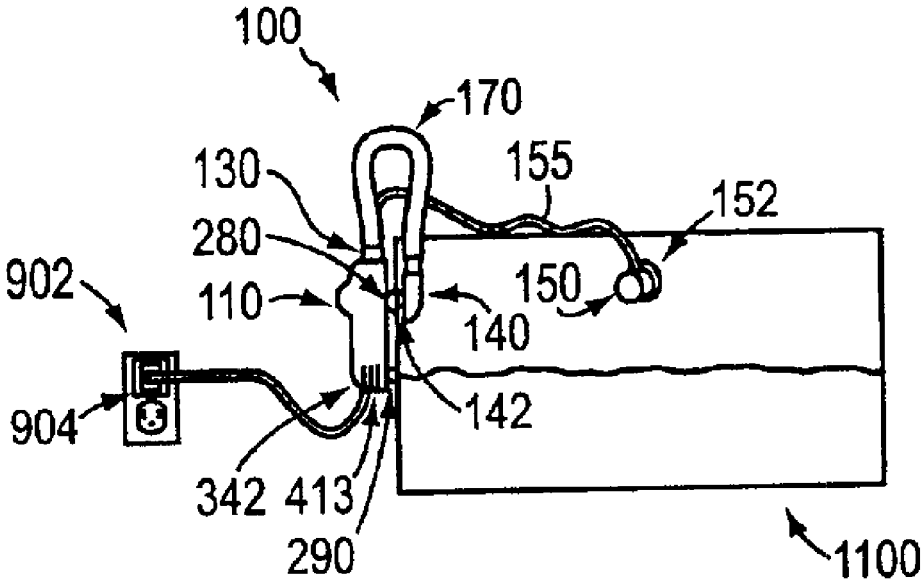
FIGS. 11A and 11B are two versions of the apparatus applied to a cat litter box.

FIG. 11A is a view of the apparatus 100 applied to use with a cat litter box 1100. The apparatus 100 is attached to the exterior of the cat litter box 1100 with attachment members 282 and is stabilized by the feet 290. The intake member 140 can be attached to the interior of the cat litter box with the attachment member 142. The sensor 150 is attached to an interior surface of the cat litter box 1100 with attachment member 152. The sensor 150 can be a motion or heat sensor, for example. In operation, if a cat enters the litter box 1100, the motion or heat sensor 150 detects movement or heat of the cat and generates a signal that travels on conductive line 155 to the control unit 601. In turn, the control unit 601 activates the motorized fan 690. The motorized fan 690 creates a pressure differential that draws malodorous air through intake member 140, conduit 170, and inlet nozzle member 130. The malodorous air passes through filter 715. Optional liquid fragrance, if applied to the filter 715, volatizes into the air passing through the filter to neutralize its scent. The air passes through the blades of the motorized fan and is expelled and dissipated via vent 413. After a predetermined time and/or if motion or heat of the cat is no longer detected, the sensor 150 deactivates its signal to turn off the motorized fan 690.

Figure 11B:
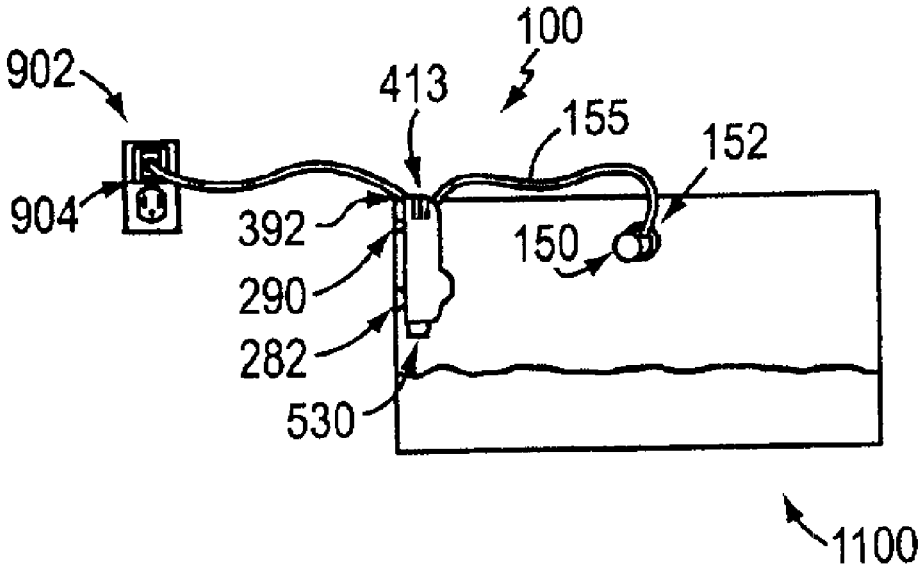
Figure 12:
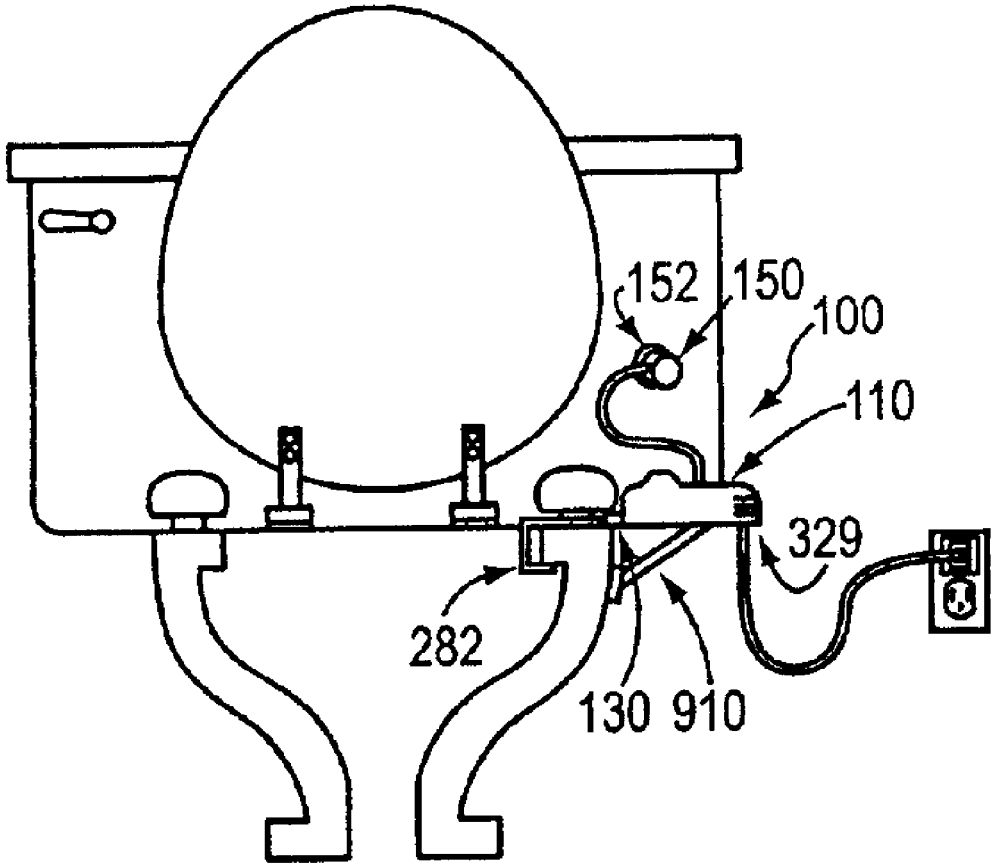
FIG. 12 is a partial cross-sectional view of a toilet stand showing a version of the apparatus with hook attachment member and brace.

FIG. 11B shows an alternative configuration of the apparatus 100 in which the inlet nozzle member 130, the conduit 170, and the intake member 140 are removed from the casing 110 of the apparatus 100, and the inlet nozzle member 530 is attached to the casing 110 of the apparatus 100 in replacement thereof. The apparatus 100 can be attached to the interior of the cat litter box 1100 with the attachment members 282 and is supported by the feet 290. The sensor 150 is attached to an interior surface of the litter box 1100 with the attachment member 152. Upon activation of the sensor 150 by movement or heat of a cat within the litter box 1100, the motorized fan 690 is activated to draw air through inlet nozzle member 530, optionally applies fragrance by drawing air through filter 715 treated with fragrant substance, and expels and dissipates such air through vent 413. After cat movement or heat stops, indicating the cat has left the litter box, and/or after a predetermined time expires, the signal supplied from the sensor 150 deactivates and the motorized fan 690 stops to conserve power and reduce wear on the apparatus 100. FIG. 12 shows an alternative configuration for the attachment member 282. In this configuration, the attachment member 282 is a hook member that engages with the rim of a toilet bowl to hold the apparatus 100 in place against the toilet stand. The hook member extends from the inlet nozzle member 130 and is positioned so as to be under the lowered seat of the toilet stand. The apparatus 100 of FIG. 12 also comprises a brace 910 that extends from the casing 110 and contacts the side of the toilet bowl to support the apparatus 100.

Figure 13:
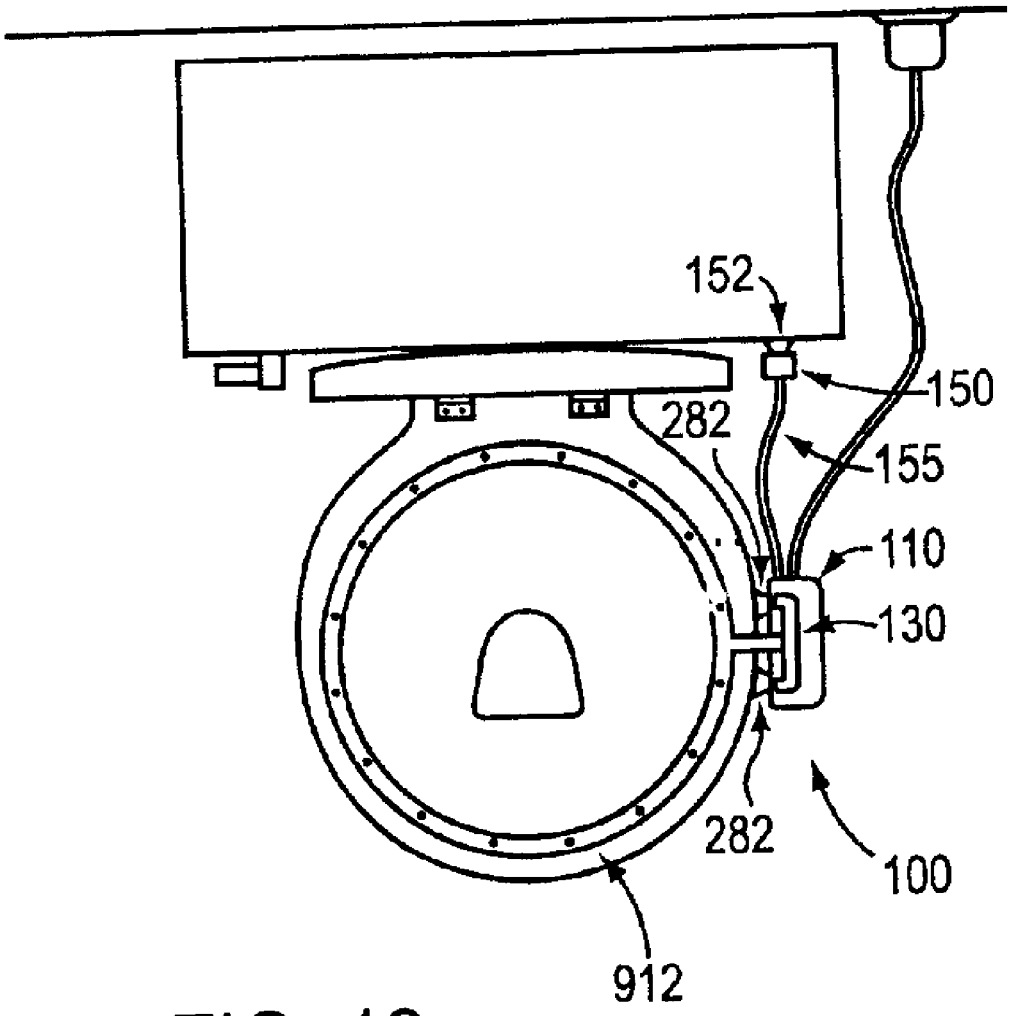
FIG. 13 is a view of a version of the apparatus with circular intake member.

FIG. 13 shows an alternative configuration of the apparatus 100 that comprises an intake member 912 configured to draw air either partially or totally around the circumference of the toilet bowl. The intake member 912 is hollow or tube-like in configuration and defines holes at intervals along its length. The intake member 912 is coupled to communicate with the inlet nozzle member 130 of the apparatus 100. Accordingly, if the motorized fan 690 of the apparatus 100 is activated, the partial vacuum generated by the motorized fan draws in air through the defined holes along the circumferential extent of the intake member 912. As another alternative configuration, the intake member 912 can be horseshoe- or arc-shaped extending only partially around the circumference of the toilet bowl.

Figure 14:
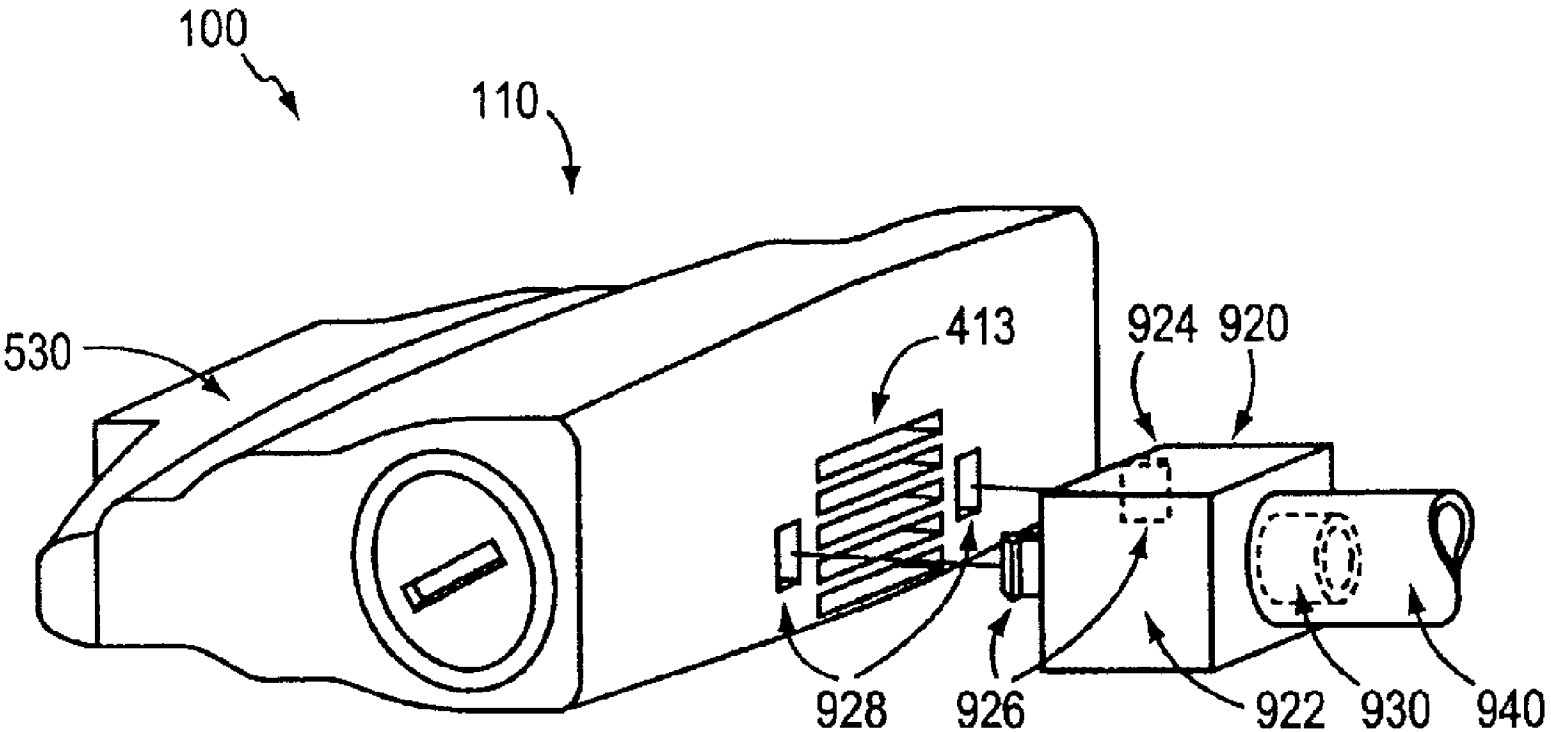
FIG. 14 is a perspective view of the apparatus with vent duct accessory.

FIG. 14 shows a vent duct 920 which is an accessory for the apparatus 100. The vent duct 920 can be coupled to any one of the configurations of the apparatus 100 disclosed herein. The vent duct 920 comprises a coupler 922 and a conduit 940. The coupler 922 can be box-like in configuration, with a solid exterior defining an interior space and an opening 924 that communicates with the interior space. The coupler 922 has coupling members 926 fixed to the coupler 922 on opposite sides of the opening 924. The coupling members 926 can be inserted into respective slots 928 defined in the casing 110 on opposite sides of the outlet port 413. The coupling members 926 are resilient and have angled ends that force the coupling members 928 to move toward one another if inserted in the slots 928. Once the angled portions of the coupling members 926 clear the surfaces of the casing 110 defining the slots 928, they snap back to their unstressed position in which the angled portions of the coupling members 926 lock the coupler 920 to the casing 110. At the end opposite the opening 924, the coupler 920 has a tube extension 930. The tube extension 930 can be inserted into conduit 940. The conduit 940 can be composed of flexible material that stretches over and grips the tube extension 930. Alternatively, or in addition, an adhesive can be applied to an outer surface of the tube extension 930 and/or an inner surface of the conduit's end so that the coupler 920 is fixed to the conduit 940.

Figure 15:
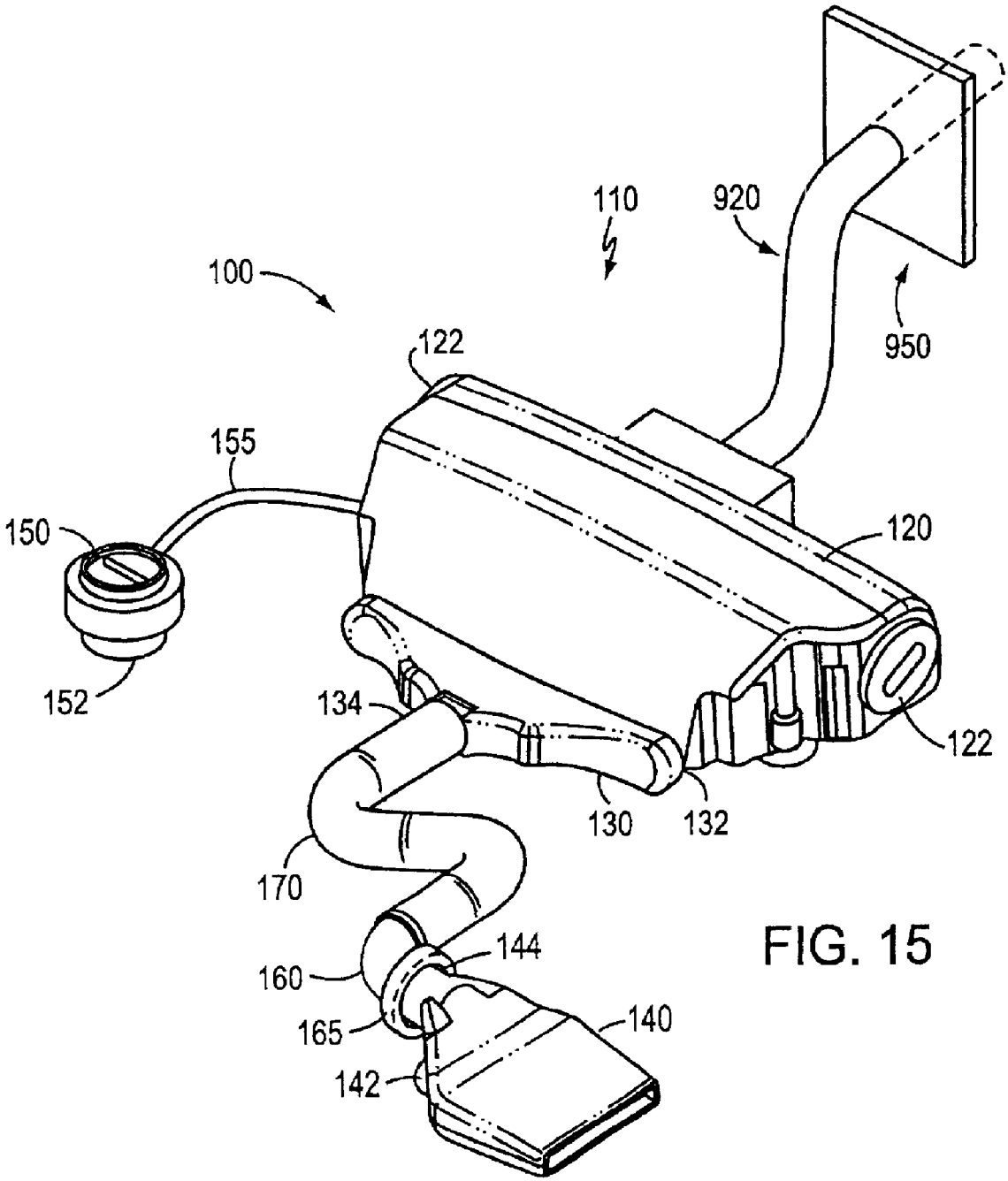
FIG. 15 is a perspective view of the apparatus using the vent duct accessory to vent air into a wall space and/or through the wall to external air.

FIG. 15 is a view of the vent duct 920 applied to duct malodorous air from the outlet port 413 of the apparatus 100 through a wall plate 950 covering an opening in an interior wall of a house or building, for example. More specifically, if the apparatus 100 is activated, its motorized fan 690 draws in and drives the malodorous or treated air through the outlet port 413 into the vent duct 920. The vent duct 920 passes through wall plate 950 and vents the malodorous or refreshed air into the wall space or entirely through the wall to be exhausted into outside air external to the house or building.

Figure 16:
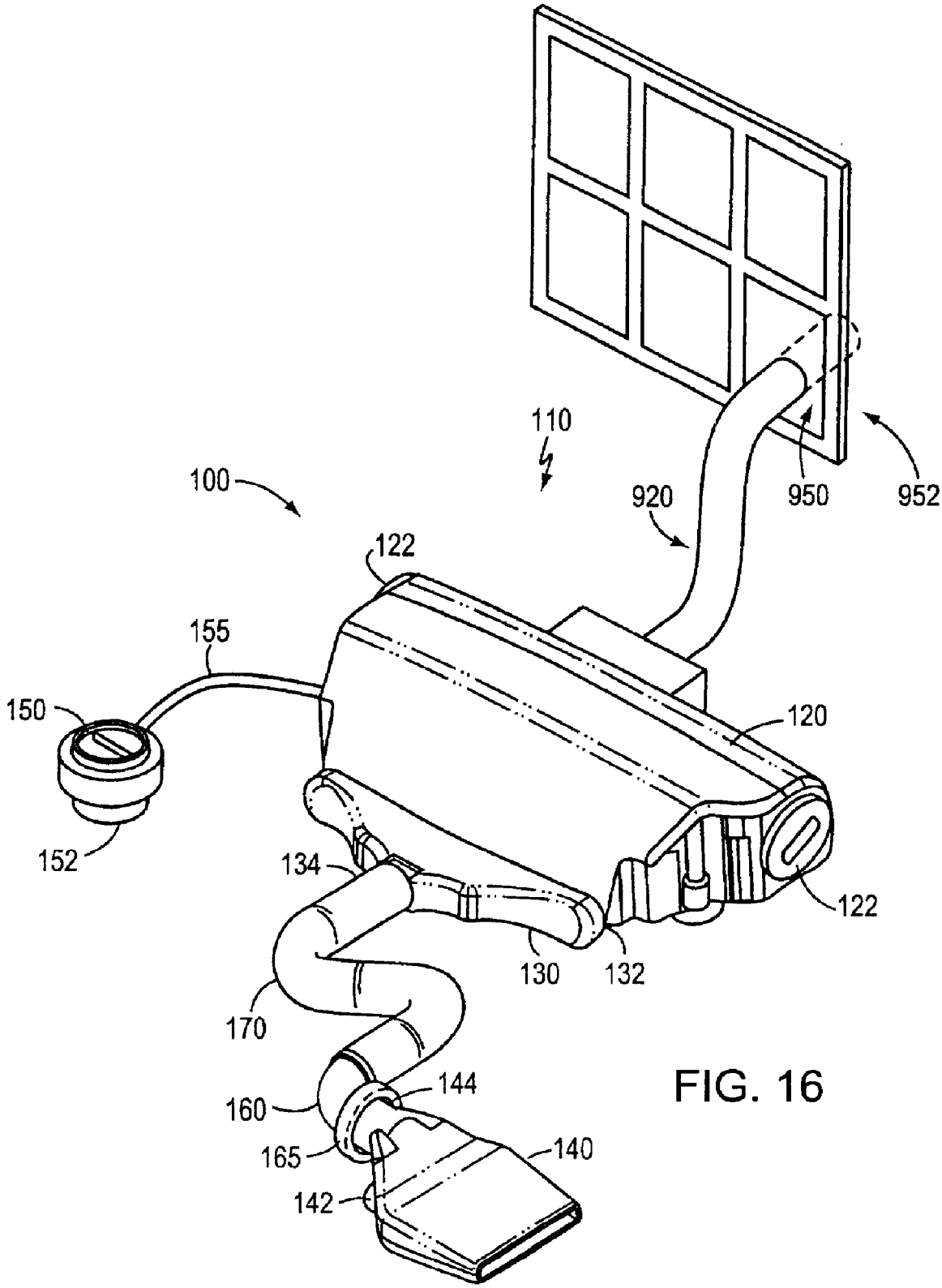
FIG. 16 is a perspective view of the apparatus using the vent duct accessory to vent air through a window to external air.

FIG. 16 is a view of the vent duct 920 applied to duct air drawn into the apparatus 100 by motorized fan 690 and driven from the outlet port 413 of the apparatus 100 through the plate 950. In FIG. 16, the plate 950 replaces a pane of a window 952. The malodorous or refreshed air can thus be vented from the apparatus 100 to ambient air outside of a house or building.

Figure 17:
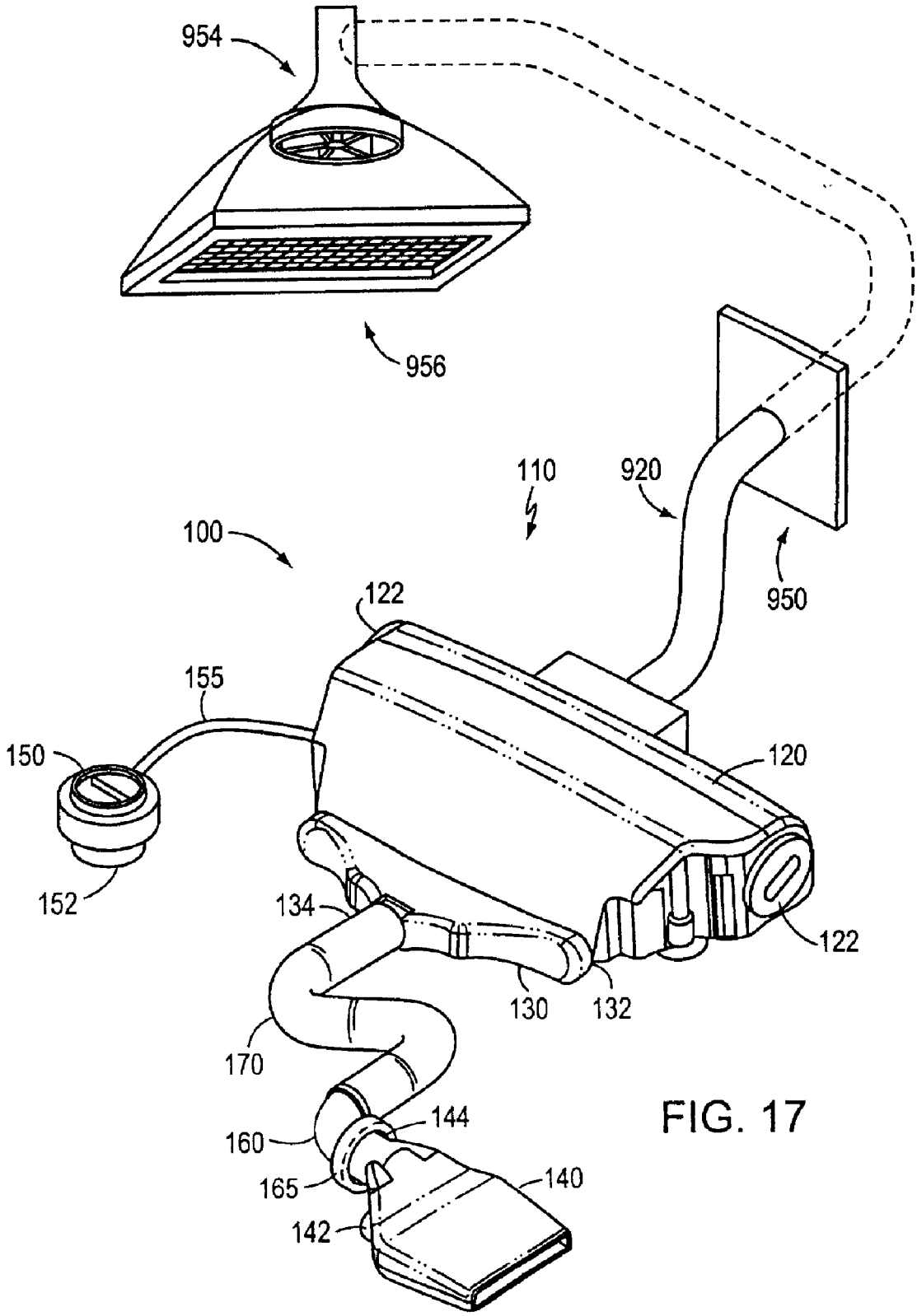
FIG. 17 is a perspective view of the apparatus using the vent duct accessory to vent air into a duct of a ceiling fan.

FIG. 17 is a view of the vent duct 920 applied to duct malodorous or refreshed air from the outlet port 413 of the apparatus 100 through a wall plate 950 into and through a wall space to a vent duct 954 of a ceiling fan 956. The malodorous or refreshed air can thus be drawn into the apparatus 100 and driven by the motorized fan of the apparatus to the ceiling fan 956 that expels such air from the house or building.

It should be understood that the foregoing relates only to the exemplary embodiments of the present invention, and that numerous changes may be made therein without departing from the spirit and scope of the invention as defined by the following claims. Accordingly, it is the claims set forth below, and not merely the foregoing illustration, which are intended to define the exclusive rights of the invention.

The invention claimed is:

1. An apparatus for ventilating malodorous air and capable of being supported by an object, the apparatus comprising:

a casing defining an inlet port and an outlet port;

at least one element coupled to the casing, for removably attaching the casing to the object;

a motorized fan creating a partial vacuum that draws the air into the inlet port and exhausts the air from the outlet port;

a conduit having a first end coupled to the inlet port;

an intake member coupled to a second end of the conduit;

at least one element coupled to the intake member, for removably attaching the intake member to the object; and a flap rotatably coupled to the intake member, the element for attaching the intake member to the object being attached to the flap.

2. An apparatus as claimed in claim 1 further comprising:

an energy source coupled to the motorized fan.

3. An apparatus as claimed in claim 1 further comprising:

a timed duration control unit coupled to the motorized fan, and controllable to activate the motorized fan for a period of time.

4. An apparatus as claimed in claim 3 further comprising:

a switch coupled to the timed duration control unit, for activating the timed duration control unit to operate the motorized fan.

5. An apparatus as claimed in claim 3 wherein the timed duration control unit is functional to provide the energy source from an internal or external energy source.

6. An apparatus as claimed in claim 1 further comprising:

a porous filter situated with respect to the casing so as to receive and filter air from the inlet port; and a fragrant substance for application to the porous filter, for treating the air from the inlet poll so as to be fragrant upon passing through the filter.

7. An apparatus as claimed in claim 1 further comprising:

an inlet nozzle member coupled to the casing and the conduit to duct air from the conduit to the inlet port of the casing, the inlet nozzle member defining a relatively wide opening where it meets with the casing and defining a relatively narrow opening where it meets with the conduit.

8. An apparatus as claimed in claim 1 wherein the element for attaching the casing to the object comprises a suction cup.

9. An apparatus as claimed in claim 1 wherein the conduit comprises a flexible hose.

10. An apparatus as claimed in claim 1 wherein the rotatable flap can rotate from zero to one-hundred-eighty degrees away from alignment with a bottom surface of the intake member.

11. An apparatus as claimed in claim 1 further comprising:

a nozzle connector having a first end coupled to the second end of the conduit and a second end rotatably coupled to the intake member to permit the intake member to rotate relative to the nozzle connector.

12. An apparatus as claimed in claim 11 wherein the nozzle connector can rotate from zero to three-hundred-sixty degrees relative to the intake member.

* * * * *